US005592897A

United States Patent [19]

Kattwinkel et al.

[11] Patent Number: 5,592,897

[45] Date of Patent: Jan. 14, 1997

[54] WATERCRAFT

[76] Inventors: Hans-Harald Kattwinkel, Burgweg 66, D-58553 Halver, Germany; Marcus Kattwinkel, Vömmelbach 89, D-58553 Halver, Germany

[21] Appl. No.: 545,595

[22] PCT Filed: Jan. 21, 1994

[86] PCT No.: PCT/DE94/00060

§ 371 Date: Oct. 18, 1995

§ 102(e) Date: Oct. 18, 1995

[87] PCT Pub. No.: WO94/26586

PCT Pub. Date: Nov. 24, 1994

[30] Foreign Application Priority Data

May 18, 1993 [DE] Germany ..... 43 16 538.9

[51] Int. Cl.[6] ..... B63B 17/00

[52] U.S. Cl. ..... 114/363; 114/122; 114/270

[58] Field of Search ..... 114/363, 188–194, 114/270, 144 R, 343, 71, 122; 297/316, 322, 344.11

[56] References Cited

U.S. PATENT DOCUMENTS

| | | | |
|---|---|---|---|
| 2,770,286 | 11/1956 | Weller | 114/363 |
| 3,294,055 | 12/1966 | McGuire | 114/270 |
| 3,483,844 | 12/1969 | Trautwein | 114/270 |

FOREIGN PATENT DOCUMENTS

| | | | |
|---|---|---|---|
| 4-185593 | 7/1992 | Japan | 114/363 |

*Primary Examiner*—Edwin L. Swinehart
*Attorney, Agent, or Firm*—Herbert Dubno

[57] ABSTRACT

A watercraft has a buoyancy hull with an upwardly bode rail forming an arcuate guide for a passenger stand which allows the passenger to remain substantially upright as the buoyancy hull rolls beneath the stand. The stand can have rollers riding on the rail.

8 Claims, 4 Drawing Sheets

WATERCRAFT

CROSS REFERENCE TO RELATED APPLICATIONS

This application is a national phase of PCT/DE 94/00060 filed Jan. 21, 1994 and based upon German application P 43 16 538.9 of 18 May 1996 under the International Convention.

FIELD OF THE INVENTION

The invention relates to a watercraft with a buoyancy hull and a passenger stand or the like secured thereon, whereby a ballast body is optionally mounted on the buoyancy hull by means of a support frame. The buoyancy hull or the support frame can have rigid support areas on both sides transversely to its longitudinal direction, the passenger stand being preferably equipped with a seat and a handlebar, whereby the handlebar is coupled to a steering system of the watercraft and on the support areas, holding elements are provided capable of accommodating the feet and possibly the calves of the passenger.

BACKGROUND OF THE INVENTION

A watercraft is known for instance from EP 0 387 253 B1. In the known device the passenger stand is linked to the buoyancy hull via supports, primarily located underneath the actual buoyancy hull. This design is not satisfactory from the construction point of view, since it requires that the buoyancy hull be traversed by the supports, which makes the entire construction very expensive. Besides the watercraft is also relatively complicated to handle.

OBJECT OF THE INVENTION

It is the object of the invention to create a watercraft of the aforedescribed kind with a simple construction and which can be easily handled.

SUMMARY OF THE INVENTION

In order to achieve this object the passenger stand is on at least one slide guide on the upper side of the buoyancy hull transversely to the longitudinal axis of the watercraft, so as to be movable along this slide guide.

It is particularly advantageous to provide the slide guide as at least one guide rail running transversely to the median longitudinal axis of the watercraft. The rail preferably is curved like an arc of a circle with a center of curvature in a vertical median plane which is formed by the median cutting plane of the watercraft, namely either between the guide rail and the boat keel or ballast body or in the boat keel or the ballast body or advantageously beyond the boat keel or the ballast body. The the passenger stand can be moved along the guide rail by means of rollers.

As a result of this construction it is possible to shape the buoyancy hull like a boat body which does not have to be traversed by supports or similar elements, but wherein the sliding of the passenger stand required for counterbalancing the motions of the buoyancy hull caused by waves can take place in a simple manner along the slide guide arranged on the upper side of the watercraft or the buoyancy hull. Thereby the construction costs are minimized and the handling is considerably simplified. The slide guide can consist of a bow curved like an arc of a circle, or of several spaced-apart bows arranged so that in a normal upright position of the buoyancy hull or the boat body the highest point of the curvature lies in the vertical median plane of the buoyancy hull or boat body. Instead of a bulge shaped like an arc of a circle an elliptical bulge or the like can be provided. However the shape of the arc of a circle is preferred.

Instead of a rigid mounting of the slide guide on the buoyancy hull or boat body, it is possible to have an adjustable mounting of the slide guide on the buoyancy hull or the boat body, whereby the adjustment can be performed during travel by means of actuators, for the purpose of adjustment to changeable influencing factors such as the motions of the sea, speed, travel direction or the like. The invention provides a watercraft wherein the person or persons using the watercraft can maintain themselves and the decoupled superstructure in active equilibrium, in an ergonomic and easily controllable manner, while the buoyancy hull is exposed to the motions of the waves.

According to a feature of the invention, a rear part of the passenger stand seen in the travel direction can have a driving unit arranged thereon. The passenger stand, moreover, can be locked in a relative centered (median) position with respect to the buoyancy hull. The passenger stand, moreover, can be designed as a cabin with a steering stand and the ballast body which can be connected to the hull can be made up of the additional weight of driving units, fuel, lading and the like.

According to another feature of the invention the support frame can be formed by narrow braced links and a fin can be affixed to the support frame. The buoyancy hull can be barrel shaped with pointed ends and can be constricted in an area close to the passenger stand. The buoyancy hull and the ballast body can be built as a boat body with the support areas to which the holding parts are linked being provided on an upper side of the boat hull. The passenger stand can be held basically vertical independently of the rolling of the buoyancy hull by length adjustable setting means controlled by a servodrive detecting the relative inclined position of the passenger stand and converting it into control signals for the actuation of the setting means.

A second slide guide can be combined with the first mentioned guide and can have setting means assigned thereto controlled via a servodrive detecting the relative position of the passenger stand with respect to the median transverse axis.

A further object of the invention is a watercraft with a buoyancy hull and a passenger stand or the like secured thereon, whereby the passenger stand by means of length-adjustable setting means which can be controlled by a servo-drive detecting the relative inclination of the passenger stand and translating it into control signals for changing the length of the setting means, remains in a basically vertical position, independent of the possible relative rotations of the buoyancy hull, and whereby further on the buoyancy hull optionally a ballast body is fastened.

In order to solve the problem mentioned in the introduction the passenger stand, which can be aligned by setting means, is supported so that it can slide along at least one slide guide directed transversely to the median longitudinal axis of the watercraft and arranged on the upper side of the watercraft or the buoyancy hull.

This way it is also possible to create a watercraft, for instance a passenger boat with a cabin, whereby the cabin represents the passenger stand and whereby the passenger stand is automatically kept in labile equilibrium, for the purpose of motion reduction. For this purpose one or more actuators are provided, which set the relative position along the slide guide. The construction according to the invention is also useful in reducing the motions in the plane which is vertical to the travel direction, for instance rolling, lateral displacement and dipping. It is also possible to have a coupling in succession of such slide guide systems in two successive vertical planes, whereby also additional motions of the passenger stand relative to the motions of the buoyancy hull caused by waves can be calmed down.

Further it is preferably provided that a second slide guide be combined with the slide guide which runs along the buoyancy hull and to which setting means are assigned controllable by a servo-drive detecting the position of the passenger stand relative to the median transverse axis of the buoyancy hull and translating it into control signals for the actuation of the setting means, so that basically the passenger stand remains vertically positioned.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
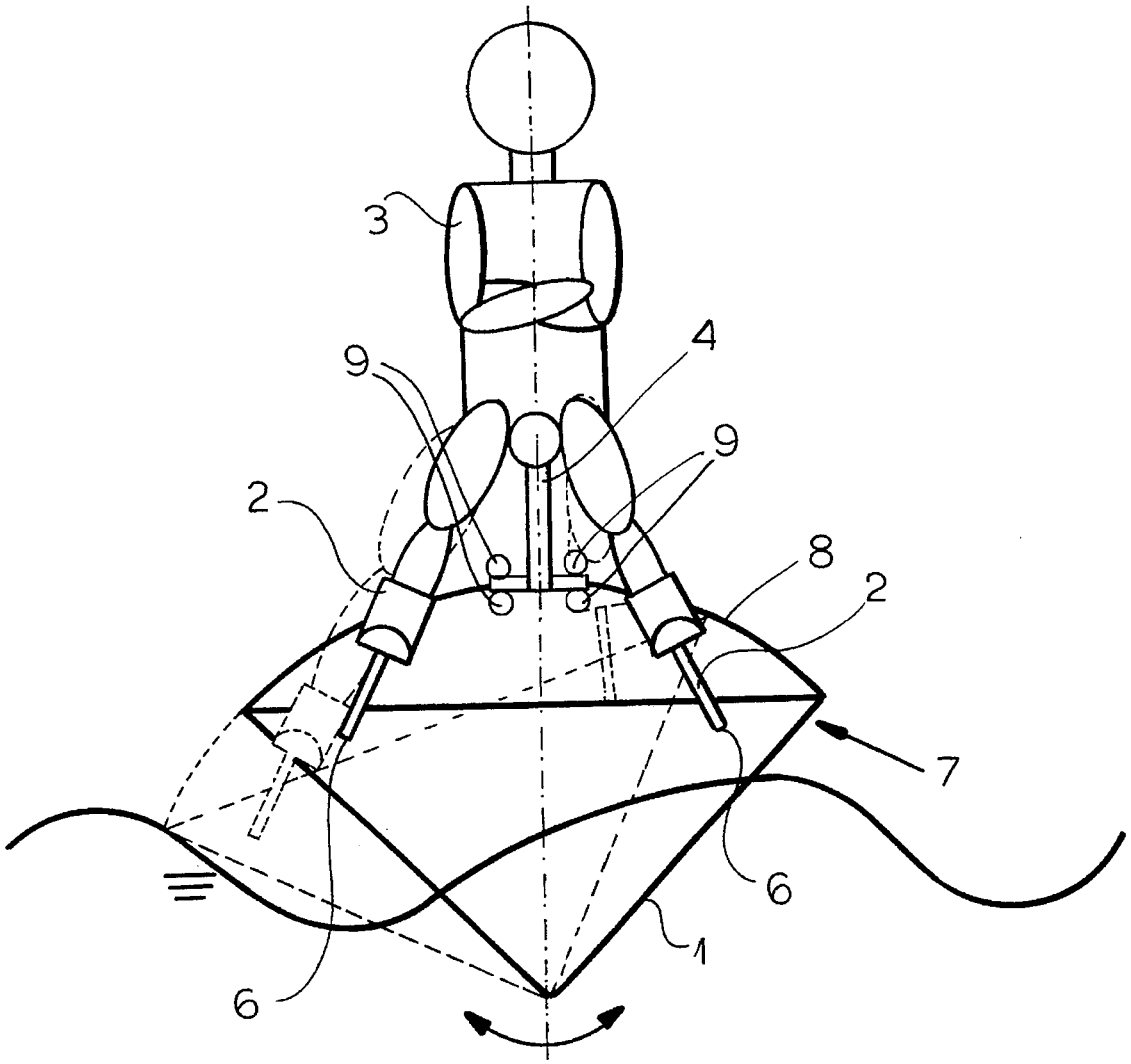
FIG. 1 is a front view of a first embodiment.

In the drawing a watercraft with a buoyancy hull 1 and a thereon supported passenger stand 4 is shown. A ballast body can be fastened for instance by a support frame on the buoyancy hull 1. It is also possible to arrange ballast weights on the buoyancy hull. The buoyancy hull 1 or a support frame fastened thereto has on both sides rigid lateral support areas 6 arranged transversely to its longitudinal direction, whereby advantageously the passenger stand is provided with a seat and a handlebar. The handlebar is coupled with a steering system for the watercraft, which is not shown in the drawing. Holding elements 2 suited for receiving the feet and optionally the calves of the passenger 3 are linked to the support areas 6.

Figure 2:
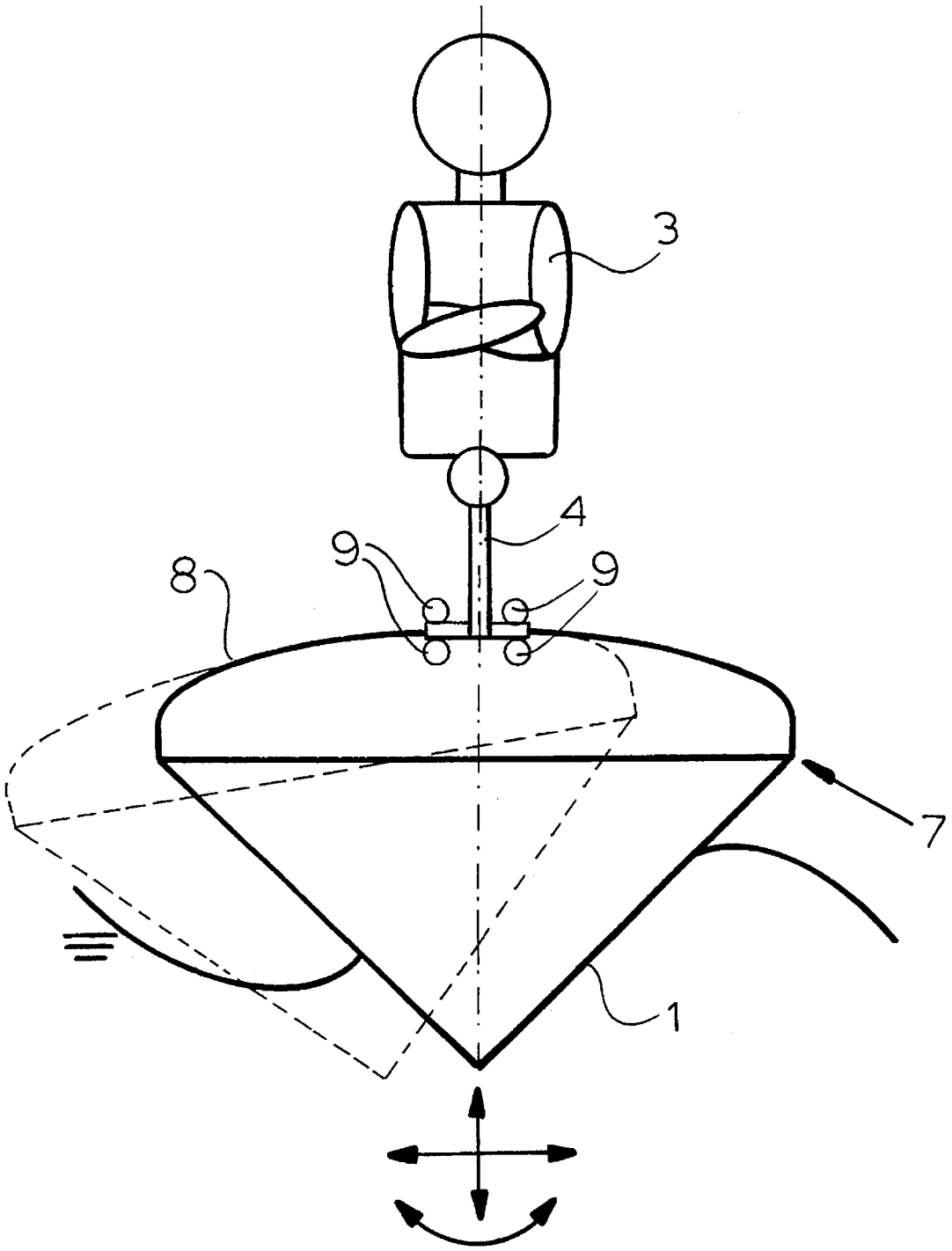
FIG. 2 is a second embodiment also in a front view.
Figure 3:
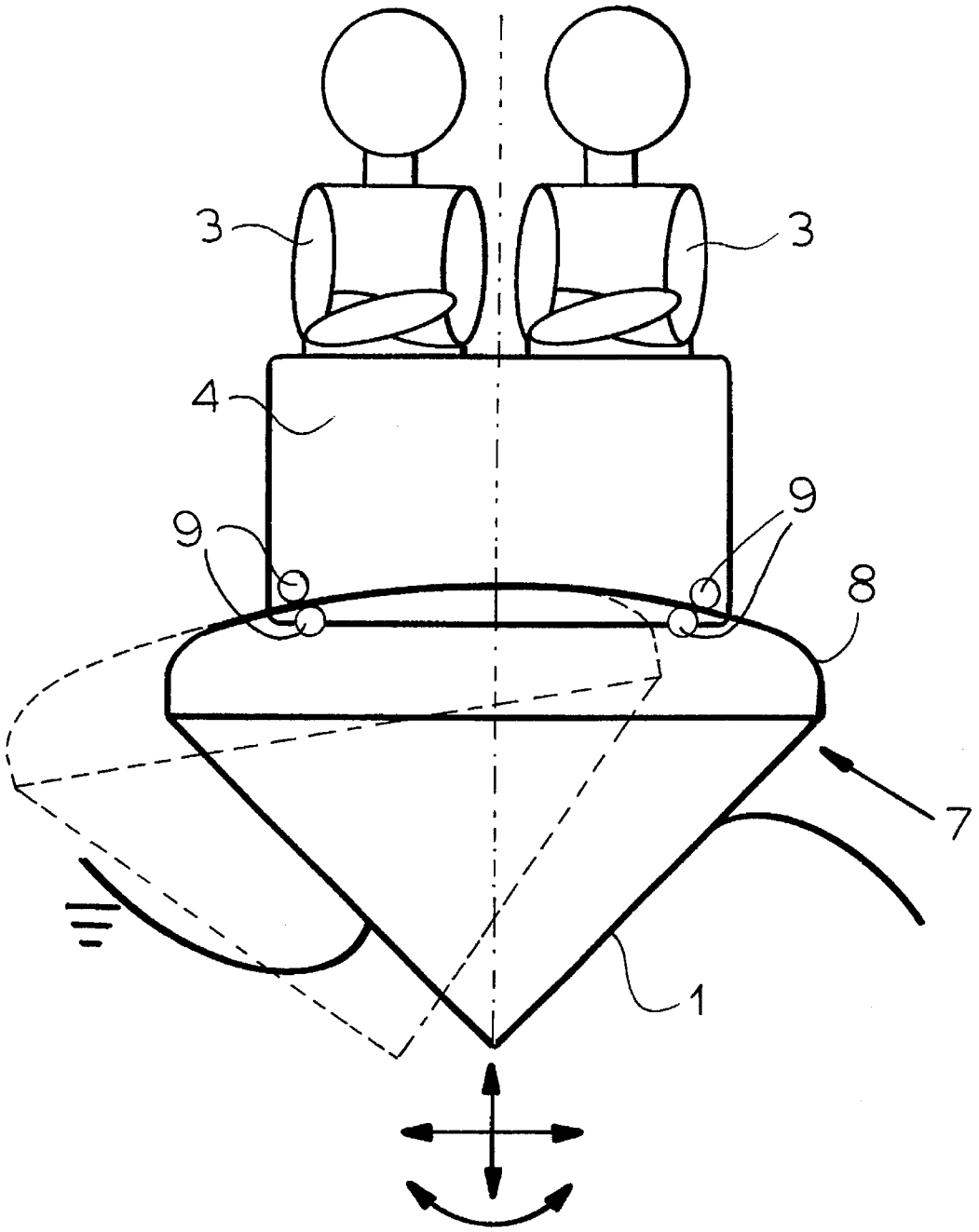
FIG. 3 is a further variant in the same view.

The passenger stand 4 is arranged to be displaceable along at least one slide guide 7, said slide guide 7 being mounted on the upper side of the buoyancy hull 1 transversely to the longitudinal axis of the watercraft. The slide guide 7 consists of a guide rail 8 running transversely to the median longitudinal axis of the watercraft or the buoyancy hull 1, which according to the embodiment in FIG. 1 is curved like an arc of circle and according to the embodiment in FIG. 2 is approximately elliptically curved and whose center of curvature according to FIG. 1 lies on a vertical median plane which is formed by the median cutting plane of the watercraft or, of the buoyancy hull 1. The center can be located between the guide rail 8 and the keel-side end (bottom) of the ballast body or boat body, or it can lie below the keel-side end of the boat body. The passenger stand 4 is displaceable along the guide rail 8 on rollers 9. Corresponding to the wave formations and to thereby caused inclination of the buoyancy hull 1, shown in broken lines in the drawing, the passenger 3 by stretching or retracting his legs can change the relative position of the slide running on rollers 9 with reference to the guide rail 8, so that independently of the motion of the buoyancy hull 1 the upright position of the passenger 3 is maintained according to FIG. 1. Of course it is also possible for the passenger to assume a slightly inclined position relative to the vertical, in order to counteract lateral winds or the like, according to external conditions. In the representation of FIG. 2 a few details of FIG. 1 have been skipped (for the sake of a better overall view), whereby however the fundamental elements according to FIG. 1 should also be present in the embodiment according to FIG. 2. In the embodiment of FIG. 3 a watercraft with a buoyancy hull 1 and thereon supported passenger stand 4 is shown. The passenger stand 4 is thereby adjustable by means of e.g. length-adjustable setting means (not shown in the drawing), which can be controlled by a servo-drive which detects the relative inclined position of the passenger stand 4 and converts it into control signals for the actuation of the setting means. As a result the passenger stand 4 remains basically in a vertical position, independently of the possible relative rotations of the buoyancy hull. Optionally on the buoyancy hull 1 ballast bodies can be mounted, or also ballast weights can be embedded in the buoyancy hull.

The passenger stand 4 which can be aligned by setting means is again mounted to be displaceable along a slide guide 7, which runs transversely to the median longitudinal axis of the watercraft and is arranged on the upper side of the watercraft, respectively the buoyancy body 1.

Figure 4:
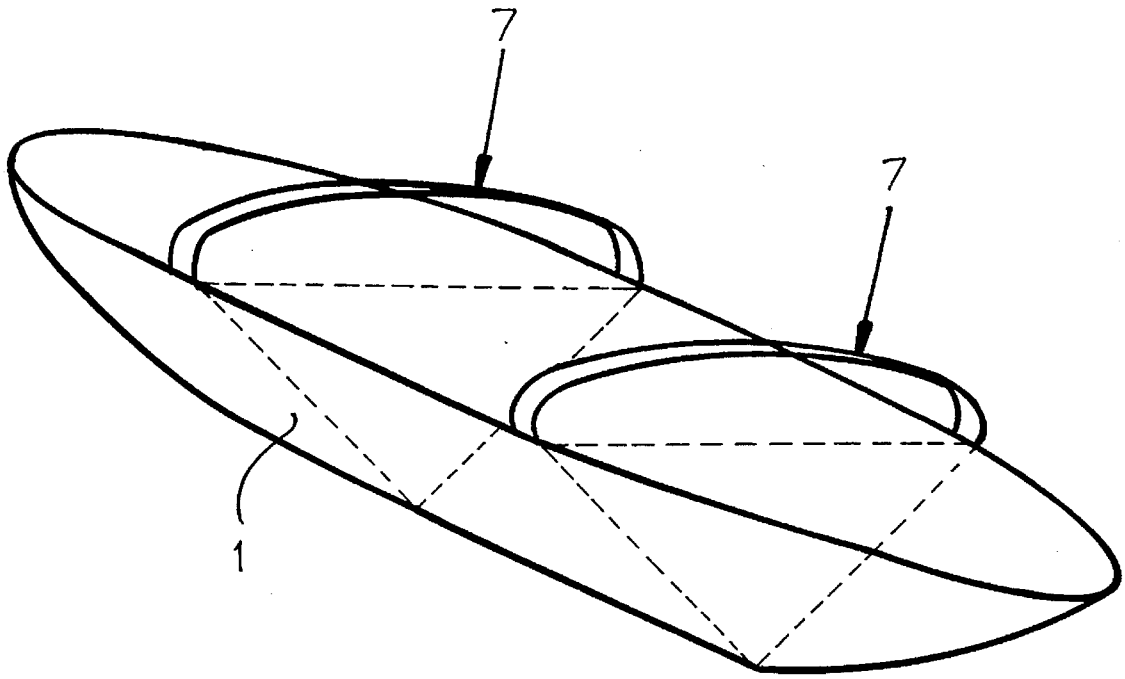
FIG. 4 is a buoyancy hull according to the invention in isometric representation.

The drawing FIG. 4 shows a buoyancy hull built like a boat body with two slide guides 7 arranged at a distance one after the other in the longitudinal direction of the boat body. It is self-understood that it is possible to have the passenger stand 4 displaceably mounted on one or more such slide guides.

Furthermore it is possible to complete the slide guide 7 with a further second slide guide in the longitudinal direction of the boat body, by means of which the motions of the boat body about its median transverse axis can be compensated, which means that the passenger stand remains approximately at rest.

Such a combined slide guide system can be built in the manner of a cross-support. The invention is not limited to the embodiment examples, but is extensively variable within the framework of the disclosure.

All novel individual or combined features mentioned in the specification are considered essential parts of the invention.

We claim:

1. A watercraft comprising:

an elongated buoyancy hull having an upper side opposite a keel side and a vertical longitudinal median plane;

an upwardly bowed arcuate guide rail on said upper side extending transversely to said plane and transversely of a longitudinal dimension of said hull;

a passenger stand displaceable along said guide rail transversely to said plane and to said longitudinal dimension to enable a passenger on said passenger stand to remain generally upright upon rolling of the buoyancy hull in response to waves; and means braced on at least one support area of said hull and enabling shifting of said passenger stand along said guide rail.

2. The watercraft defined in claim 1 wherein said means braced on at least one support area includes:

a pair of holding elements linked to said hull at respective support areas thereof and receiving legs of a passenger on said passenger stand.

3. The watercraft defined in claim 1 wherein said passenger stand includes a seat for the passenger.

4. The watercraft defined in claim 1 wherein said passenger stand has rollers riding on said rail.

5. The watercraft defined in claim 1 wherein said passenger stand includes a cabin receiving at least one passenger.

6. The watercraft defined in claim 1 wherein said hull is barrel shaped and has generally printed ends.

7. The watercraft defined in claim 1 wherein said rail extends over a circular arc having a center in said plane.

8. The watercraft defined in claim 1 wherein said rail extends over an elliptical arc.

* * * * *